US005963179A

United States Patent [19]

Chavez

[11] Patent Number: 5,963,179

[45] Date of Patent: Oct. 5, 1999

[54] VARIABLE AZIMUTH MOUNTING ASSEMBLY FOR PANEL ANTENNAS

[75] Inventor: Edward Chavez, Euless, Tex.

[73] Assignee: Allen Telecom Inc., Solon, Ohio

[21] Appl. No.: 08/861,614

[22] Filed: May 22, 1997

[51] Int. Cl.[6] ..... H01Q 1/12

[52] U.S. Cl. ..... 343/892; 343/765; 343/882

[58] Field of Search ..... 343/880, 882, 343/892, 765, 890, 891; 248/284.1, 291.1, 910; 52/27, 29

[56] References Cited

U.S. PATENT DOCUMENTS

| | | | |
|---|---|---|---|
| 4,799,064 | 1/1989 | Nakamura | 343/766 |
| 4,931,809 | 6/1990 | Putman et al. | 343/882 |
| 5,440,318 | 8/1995 | Butland et al. | 343/882 |
| 5,526,010 | 6/1996 | Plunk | 343/882 |
| 5,554,998 | 9/1996 | Sherwood et al. | 343/881 |

*Primary Examiner*—Don Wong
*Assistant Examiner*—Tho Phan
*Attorney, Agent, or Firm*—Laff, Whitesel & Saret, Ltd.

[57] ABSTRACT

A bracket assembly for fixedly mounting an RF antenna to a support structure while permitting azimuth adjustment comprising a first bracket member adapted for fixed securance to the support structure and having a forwardly extending plate defining a first bolt hole and a spaced away arcuate slot defined by a radius of curvature about the center of the first bolt hole. A second bracket member mounted to the first bracket member and adapted for mounting an antenna, the second bracket member providing second and third bolt holes; whereby when the first and second fasteners are loose, the second bolt may move along the length of the arcuate slot to adjust the angular relationship of the bracket members and when the fasteners are tightened, the angular relationship of the bracket members is fixed.

13 Claims, 4 Drawing Sheets

VARIABLE AZIMUTH MOUNTING ASSEMBLY FOR PANEL ANTENNAS

BACKGROUND OF THE INVENTION

Panel antennas are usually mounted on walls or poles in a fixed position. To change the direction of orientation of a mounted panel antenna thereafter is difficult. For pole mounted antennas, it is necessary to loosen the attached antenna and then to rotate the antenna relative to the pole, and then fixedly clamp it in position again. For wall mounted assemblies, elaborate procedures are necessary to change the mounting of the panel assembly from one which is parallel to the wall to some other angular orientation.

It would be desirable to provide for the wall mounting of a panel antenna which facilitates the easy and rapid change of orientation, all while maintaining the panel antenna in close proximity to the wall upon which it is mounted. It would also be desirable to provide for easy change of azimuth of a pole mounted panel antenna.

SUMMARY OF THE INVENTION

In accordance with the present invention, an improved mounting system for an RF antenna, such as an RF panel antenna, is provided.

A bracket assembly of the present invention for mounting an RF antenna while permitting azimuth adjustment comprises a first bracket member adapted for fixed securance to a support structure and having a forwardly extending plate defining a first bolt hole and a spaced away arcuate slot defined by a radius of curvature about the center of the first bolt hole, a second bracket member mounted to the first bracket member and adapted for mounting an antenna, the second bracket member providing second and third bolt holes, a first fastener in the first and second bolt holes and a second fastener in the slot and the third bolt hole, whereby when the fasteners are loose, the second bolt may move along the length of the arcuate slot to adjust the angular relationship of the first and second bracket members and when the fasteners are tightened the angular relationship of the bracket members is fixed. Desirably, the first bracket member defines a scale along the arcuate slot, and the slot defines a circular arc of at least 30°, and desirably 45°, about the first bolt hole.

In one form, the bracket assembly forwardly extending plate defines a fourth bolt hole and a spaced away second arcuate slot defined by a radius of curvature about the center of the fourth bolt hole, and the second bracket member provides fifth and sixth bolt holes, and wherein when a first fastener is disposed in the fourth and fifth bolt holes and a second fastener is disposed in the arcuate slot and sixth bolt hole and the fasteners are loose, the second fastener may move along the length of the arcuate second slot to adjust the angular relationship of the first and second bracket members and when the first fastener and a second fastener are tightened, the angular relationship is fixed. In a most preferred form, the first and second slots are positioned between the first and fourth bolt holes, and wherein when first and second fasteners are positioned, respectively, in the first and second bolt holes and in the third bolt hole and the first slot, the second bracket member may move in a counterclockwise direction relative to the first bracket member and when first and second fasteners are positioned, respectively, in the fourth and fifth bolt holes and in the second bolt hole and the second slot, the second bracket member may move in a clockwise direction relative to the first bracket member.

The bracket assembly preferably comprises a third bracket member mounted on the second bracket member, the third bracket member being adapted for securance to an antenna.

Desirably, the bracket assembly is employed in an RF antenna assembly for mounting to a support structure, the assembly including an antenna and a pair of the spaced brackets, each bracket comprising a first bracket member adapted for fixed securance to a support structure and comprising a back plate and a forwardly extending plate providing the bolt holes and slots, and wherein each second bracket member includes a mounting member which is fixedly secured to the antenna, the second bracket and mounting member being removeably secured. In one form, the back plates of the first bracket members define a common plane, each mounting member projecting equidistantly outwardly from its associated second bracket member for mounting the antenna in a plane parallel to the plane of the back plates. In another form, the back plates of the first bracket members define a common plane, each mounting member projecting unequally outwardly from its associated second bracket member for mounting the antenna in a plane disposed at a tilt angle to the plane of the back plates.

Further objects, advantages and features of the present invention will become apparent from the following drawings and description.

DETAILED DESCRIPTION OF THE PREFERRED EMBODIMENT

Figure 1:
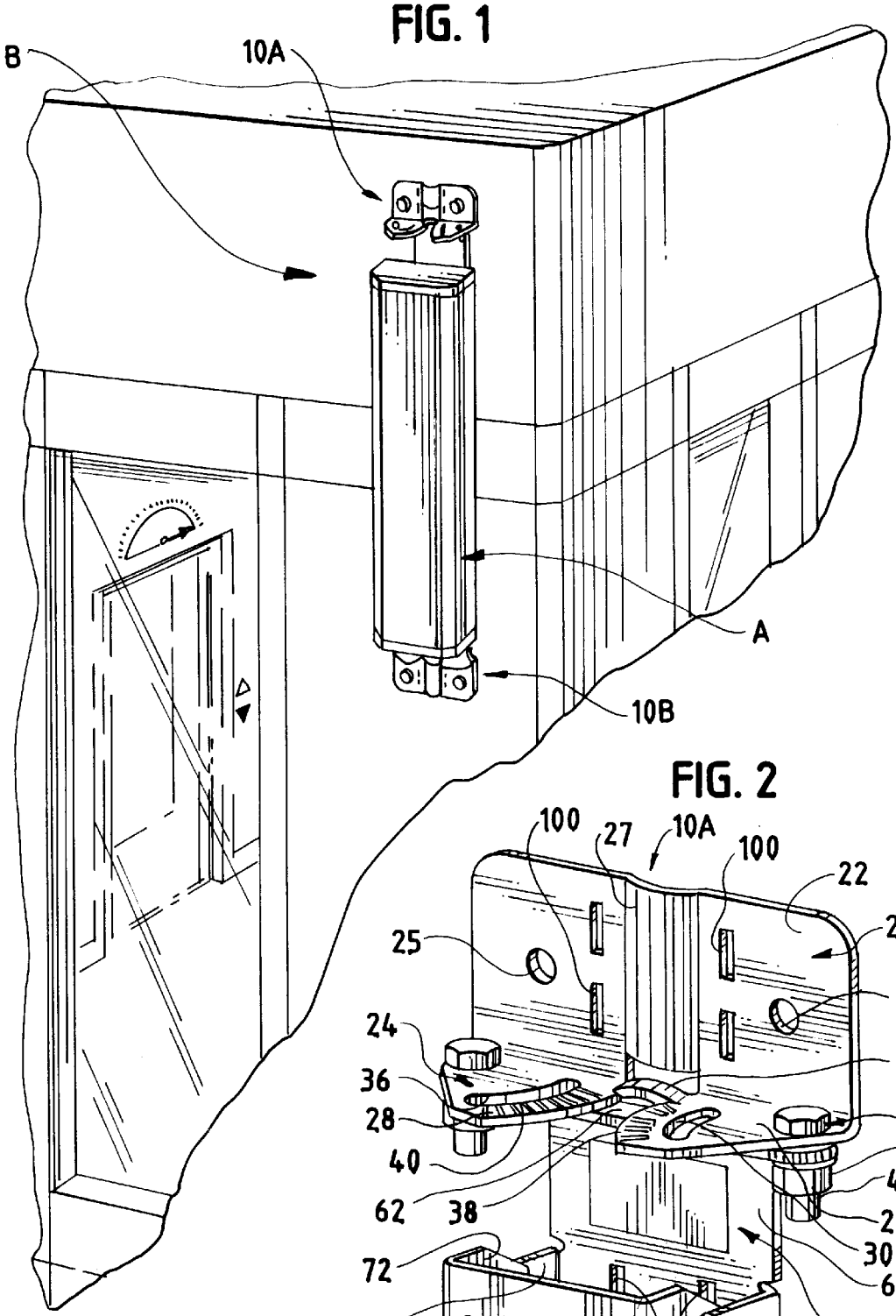
FIG. 1 is a perspective view of a panel antenna secured to the wall surface of a building with a bracket assembly of the present invention.
Figure 2:
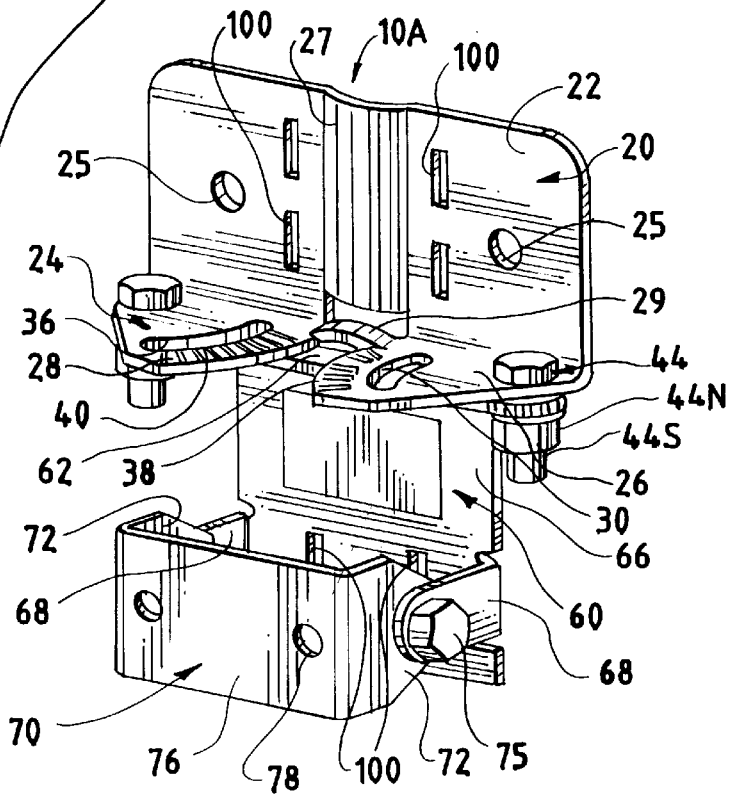
FIG. 2 is a perspective view of an upper bracket of a pair of like azimuth adjusting brackets for mounting a panel antenna to a wall surface.
Figure 3:
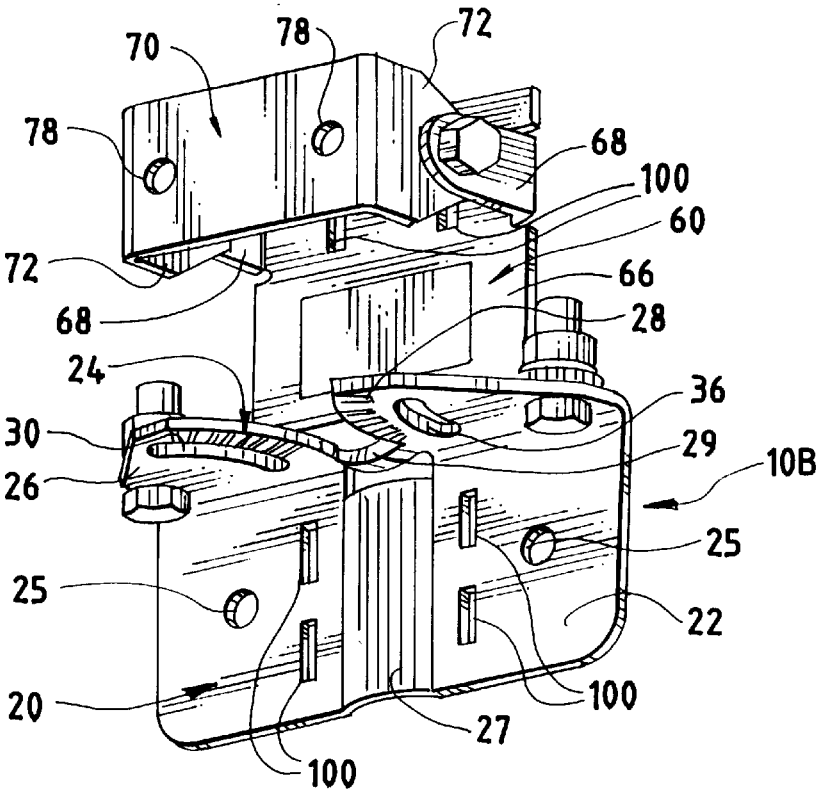
FIG. 3 is a perspective view of a lower bracket of a pair of like azimuth adjusting brackets for mounting a panel antenna to a wall surface.
Figure 4:
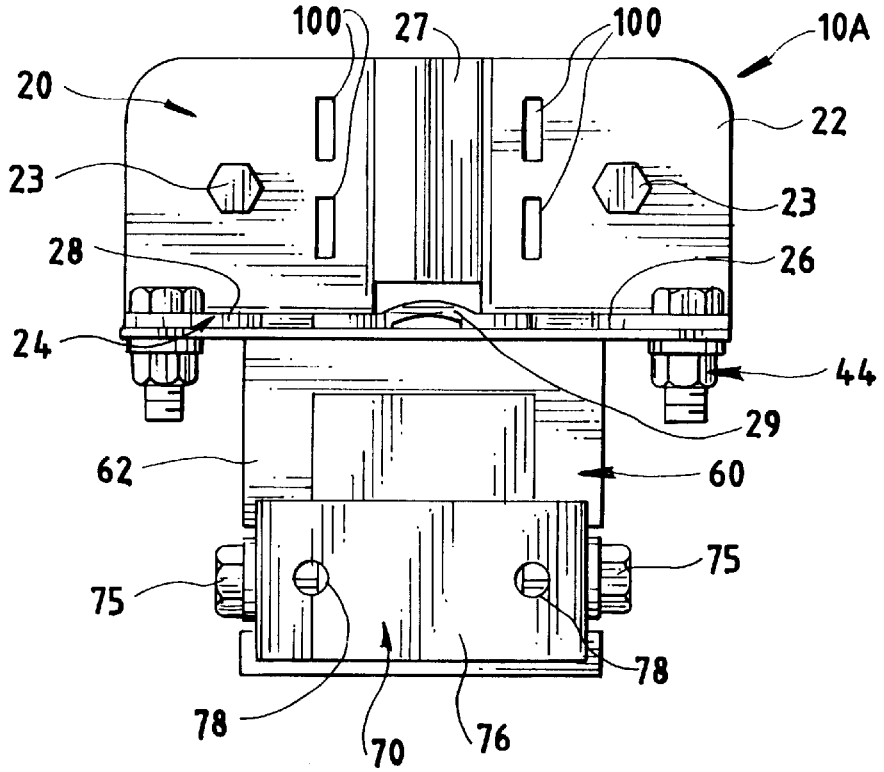
FIG. 4 is a front elevational view of the bracket of FIG. 2.
Figure 5:
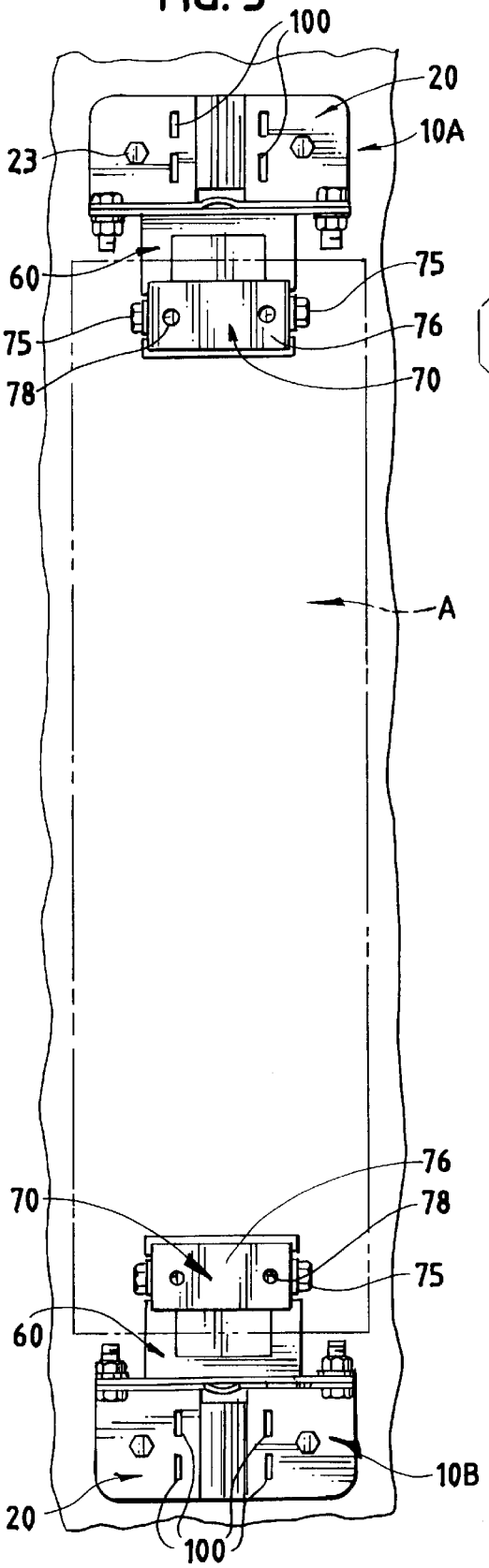
FIG. 5 is a front view of the brackets of FIGS. 2 and 3 with a panel antenna (in phantom) attached thereto.

Now referring to FIGS. 1–9, a panel antenna assembly of the present invention is shown therein. FIG. 1 is a perspective view of a panel antenna A mounted to a wall surface by a bracket assembly 10 for permitting azimuth adjustment in accordance with the present invention. The wall surface may be an exterior building wall surface B or may be a wooden plate or the like affixed to the wall. The panel antenna A may be any panel antenna and is usually one which is most efficient when properly oriented relative to the coverage area it is to serve. Such antennas are commonly used for cellular and PCS service, but are not so limited.

The bracket assembly 10 preferably comprises a pair of vertically spaced upper and lower brackets 10A and 10B, and which may be essentially identical, preferably with one facing up and the other facing down. Each is adapted for fixed securance to a support structure such as wall B. To that end, the respective parts of brackets 10A and 10B will be identified with the same respective part numbers.

Bracket 10A comprises a first wall mounted bracket member 20 and a second panel mounted bracket portion 60. Bracket member 20 comprises a generally vertically oriented back plate or mounting plate 22 and a forwardly extending adjustment plate 24 defining hinge axes and arcuate slots. The brackets may be secured to a wall or plate by fasteners 23 through bolt holes 25 in plate 22. Plate 24 desirably comprises a first azimuth plate portion 26 and a second azimuth plate portion 28. Plate portion 26 defines a hinge axis or bolt hole 30 (FIG. 8) and an arcuate adjustment slot 32. Plate portion 28 defines a hinge axis or bolt hole 34 (FIG. 7) and an arcuate adjustment slot 36. Slots 32, 36 lie along arcs, each having a radius of curvature, respectively, about its hinge axis. Slots 32, 36 are disposed between the respective hinge axes 30, 34. Each of the plate portions 26, 28 defines an adjustment scale 38, 40, respectively. The adjustment scales lie parallel to the respective arcuate adjustment slots 32, 36 and subdivided into selected increments, such as in five degree (5°) increments or subdivisions.

Figure 6:
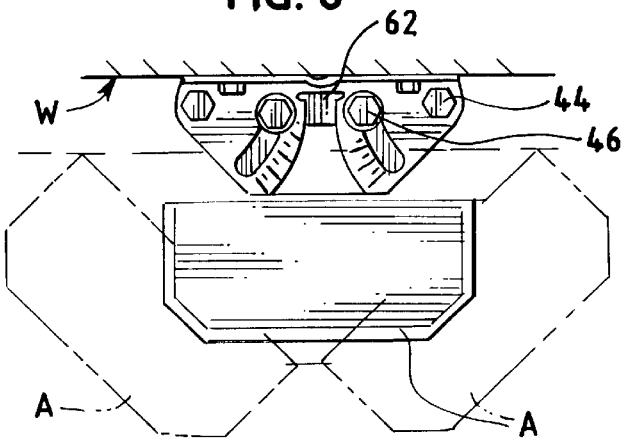
FIG. 6 is a top plan view of the bracket of FIG. 2 with a panel antenna secured thereto and shown in an orientation parallel to the wall surface of a building.

Bracket member 20 is secured to the bracket portion 60 by a pair of threaded fasteners such as bolts 44, 46. Bolt 44, which may comprise a nut 44N and threaded stud 44S, is secured in bolt hole 30 (or could be secured in bolt hole 34). Bolt 46 is secured in the arcuate adjustment slot 32 (or could be secured in slot 36). As will appear, when bolt 44 is loose and is mounted in hole 30, bolt 46 may move counterclockwise along the length of slot 32 which, from front-to-back, describes at least a 30° arc and preferably at least a 45° arc taken about the hinge point or center point defined by the bolt 44 (see FIG. 7). Similarly, when bolt 44 is positioned in bolt hole 34 in plate portion 28 and bolt 46 is loosened and is positioned in slot 36 in plate portion 28, the bolt 46 may move in a clockwise direction (from back-to-front) along the length of the slot in a 45° arc taken about the hinge point or center point of the bolt 44 (see FIG. 8). Of course, if the panel antenna A is to be maintained parallel to a wall W (as shown by FIG. 6), either pair of holes and slots 30, 32 or 34, 36 could be used.

Referring now to bracket portion 60, this comprises an upper, horizontal plate 62 upon which plate portions 26, 28 are supported. Plate 62 defines a pair of openings 64 in line with the bolt holes 30, 34. As such, bolts 44, 46 may be positioned in openings 64, with one hole 30 or 34 and an opening 64 secured by a bolt to permit pivoting, as necessary, of the plates 62 relative to plate portion 26 or 28, with the bolt 46 positioned in one of the openings 64 and a slot 32, 36 to permit the bracket portion 60 to move within a range of 45° (on either side) relative to the bracket member 20. The bolts 44, 46 may then be tightened and clamped in position, as with lock washers, to maintain a desired and particular angular orientation between the bracket portion 60 and the bracket member 20. When the bolts are tightened, the angular relationship of the bracket members is fixed.

To enhance the structural strength of the bracket member 20, it may be provided with central corrugations 27, 29, respectively.

The bracket portion 60 further includes a vertically oriented plate 66 having a pair of forwardly projecting ears 68. Ears 68 mount a U-shaped third member or mounting plate 70. Sides 72 of plate 70 define bolt holes 74 (as do ears 66) by which the respective pairs of holes and ears are connected as by nuts and bolts 75. The bracket plate 76 of plate 70 defines openings 78 for screws or the like for securance to the panel antenna A.

As will be appreciated, a pair of vertically spaced brackets 10A and 10B are so secured to a wall W and a panel antenna A, and cooperate to allow the azimuth of the antenna to be easily adjusted and fixed within ranges of 45° on each side, all without dismantling or removing and remounting the panel antenna A.

Figure 7:
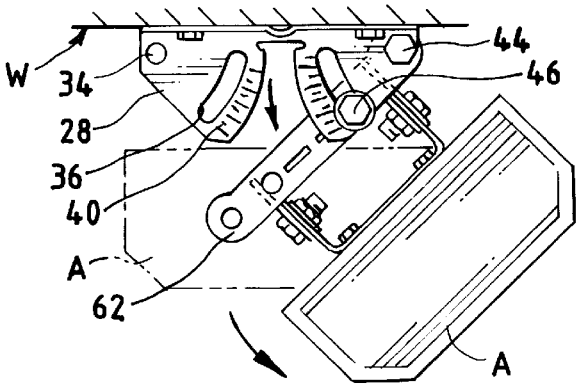
FIG. 7 is a view like FIG. 6, but with the panel antenna moved counterclockwise to a 45° angle, relative to the mounting bracket.
Figure 8:
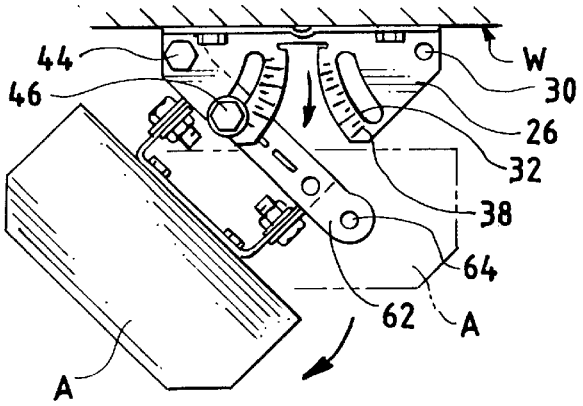
FIG. 8 is a view like FIG. 6, but with the panel antenna moved clockwise to a 25° angle relative to the mounting bracket.

As illustrated by FIGS. 6, 7 and 8, the panel antenna A may be mounted parallel to the wall W or may be adjusted in clockwise (FIG. 8) or counterclockwise (FIG. 7) directions so that the radiation pattern may be directed to maximize the effectiveness of the antenna.

Figure 9:
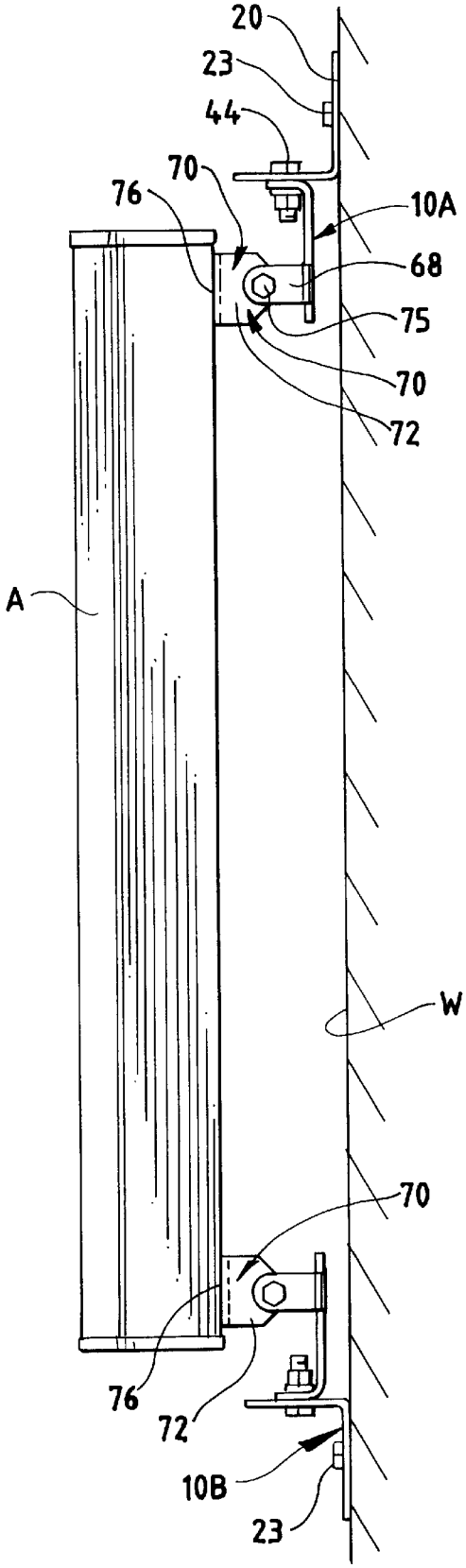
FIG. 9 is a side elevational view of the panel antenna and mounting brackets secured to the side wall of a building.

As shown in FIG. 9, the bracket assembly 10 comprising brackets 10A and 10B is proportioned so that if the wall W is vertical, the panel antenna A is oriented truly vertically. To that end, the U-shaped plates 70 have their back plates 76 in a plane parallel to the wall W and to the back plates 22 of the bracket members 20. Thus, the back plates 76 project equidistantly outwardly from the associated second bracket member thereby to mount the antenna in a plane parallel to the wall.

Figure 10:
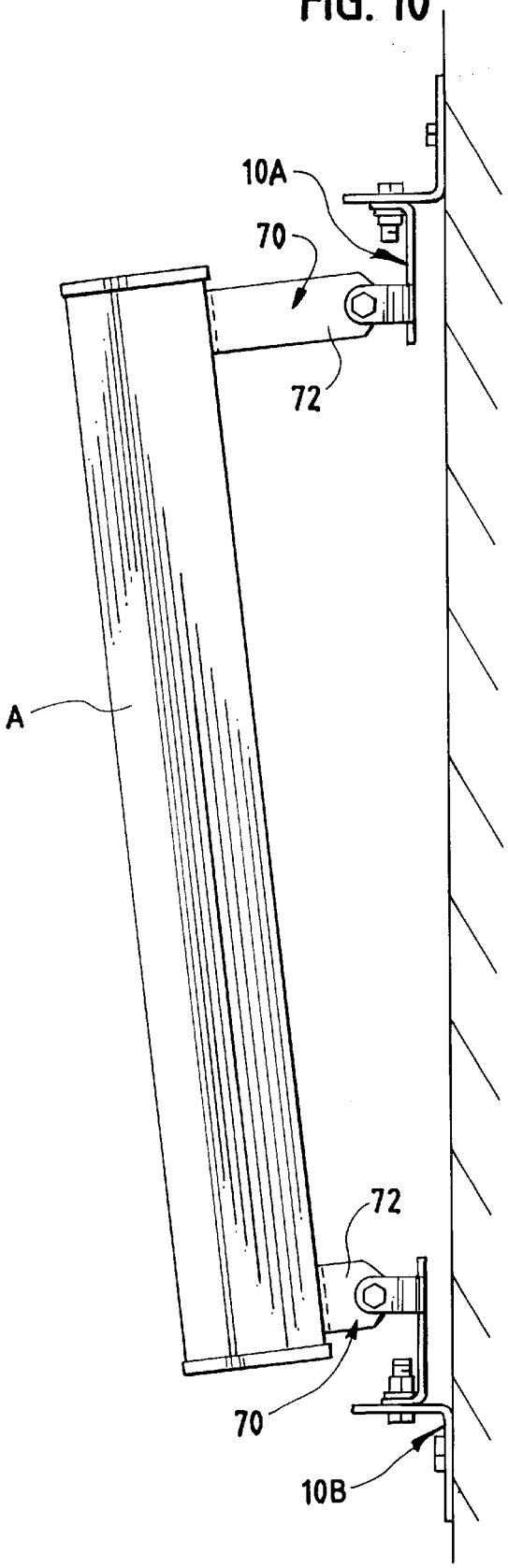
FIG. 10 is a view like FIG. 9, except that the brackets mount a panel antenna at an angle in side elevation to adjust the angle of the radiation pattern relative to the horizontal.

If, however, there is a reason or desire to change the orientation of the panel antenna A from the vertical, then, as illustrated by FIG. 10, that may be done as by using U-shaped plates 70 at the upper and lower brackets 10A and 10B which have different length sides 72 (thus the mounting members project unequally outwardly from the associated bracket member) which will position the back plates 76 to which the panel antenna A is secured in a plane which is at an acute angle to the wall W and to the plane defined by the back plates 22 of the bracket member 20. That will pitch the panel antenna A forwardly and downwardly (as seen in FIG. 10) or forwardly and upwardly, if the sides 72 of lower plate 70 are longer.

Although the brackets 10A and 10B have been illustrated as being mounted to a wall surface, they can be otherwise fixedly secured to a supporting surface or structure, such, for example, a pole. In such a case, the mounting plates 22 can be permanently secured, as by steel band clamps (not shown), to a pole. For that purpose, slots 100 are punched out of the bracket members 20 and the bracket portion 60. Once that has been accomplished, a panel antenna A can be adjusted in the same manner described via the azimuth adjusting slots.

A typical bracket assembly of the present invention may be embodied in upper and lower brackets which are approximately seven inches in length and about five inches in width. The back of the panel antenna may be mounted only about 2½ inches away from a back wall, a relatively minimal distance. It can also be mounted easily to a pole ranging from 1½ inches in diameter to six inches or more with heavy duty band clamps. The bracket assembly may be made of heavy-duty, hot-dipped, galvanized steel to provide for long-term service.

The bracket assembly can mount the panel antenna at an azimuth of 45° to either side, namely through a range of 90°, all while maintaining the antenna in close proximity to the mounting surface or wall, i.e., minimizing the clearance relative to the wall. Angle markers are stamped into the brackets to accurately show the angle between the antenna and the wall for easy setting of the desired azimuth for the antenna. That provides both structural and aesthetic advantages. The fastener system which provides two bolts at each of the top and bottom will eliminate unintentional rotation due to wind or other influences. Finally, the bracket assembly may be modified with a mechanical downtilt bracket which can easily be installed without increasing the clearance between the antenna and the wall (at least at one bracket), thereby maintaining the structural integrity and aesthetic appearance of the antenna assembly.

From the foregoing, it will be apparent to those skilled in the art that modifications may be made without departing from the spirit and scope of the invention. Accordingly, the invention is not to be limited except in accordance with the claims.

What is claimed is:

1. A bracket assembly for mounting an RF antenna while permitting azimuth adjustment comprising:

a first bracket member adapted for fixed securance to a support structure and having a forwardly extending plate defining a first bolt hole and a spaced away first arcuate slot defined by a radius of curvature about the center of said first bolt hole;

a second bracket member mounted to said first bracket member and adapted for mounting an antenna, said second bracket member providing second and third bolt holes;

a first fastener in said first and second bolt holes;

a second fastener in said first arcuate slot and said third bolt hole;

whereby when said first and second fasteners are loose, said second fastener may move along the length of said first arcuate slot to adjust the angular relationship of said first and second bracket members and when said first and second fasteners are tightened the angular relationship of said bracket members is fixed, and wherein said forwardly extending plate defines a fourth bolt hole and a spaced away second arcuate slot defined by a radius of curvature about the center of said fourth bolt hole, said first and second arcuate slots lying in a common plane, and wherein said second bracket member provides fifth and sixth bolt holes, and wherein when a third fastener is disposed in said fourth and fifth bolt holes and a fourth fastener is disposed in said second arcuate slot and sixth bolt hole and when said third and fourth fasteners are loose, said fourth fastener may move along the length of said second arcuate slot to adjust to the angular relationship of said first and second bracket members and when said third fastener and said fourth fastener are tightened, the angular relationship is fixed.

2. A bracket assembly in accordance with claim 1, and wherein said first bracket member defines scales along said first and second arcuate slots, and said slots first and second arcuate define circular arcs of at least 30° about said first and fourth bolt holes.

3. A bracket assembly in accordance with claim 2, and wherein said first and second arcuate slots define circular arcs of at least 45° about said first and second bolt holes.

4. A bracket assembly in accordance with claim 1, and wherein said first and second arcuate slots are positioned between said first and fourth bolt holes, and wherein when first and second fasteners are positioned, respectively, in said first and second bolt holes and in said third bolt hole and said first arcuate slot, said second bracket member may move in a counterclockwise direction relative to said first bracket member and when first and second fasteners are positioned, respectively, in said fourth and fifth bolt holes and in said second bolt hole and said second arcuate slot, said second bracket member may move in a clockwise direction relative to said first bracket member.

5. A bracket assembly in accordance with claim 1, and wherein said bracket assembly comprises a third bracket member mounted on said second bracket member, said third bracket member being adapted for securance to an antenna.

6. A bracket assembly in accordance with claim 1, and wherein said fasteners each comprise a bolt and a nut.

7. An RF antenna assembly for mounting to a support structure for permitting azimuth adjustment comprising an antenna and a pair of vertically spaced brackets, each said bracket comprising a first bracket adapted for fixed securance to the support structure and comprising a back plate and forwardly extending plate defining a first bolt hole and a spaced away first arcuate slot defined by a radius of curvature about the center of said first bolt hole, a second bracket member mounted to said first bracket member and secured to said antenna, said second bracket member providing second and third bolt holes, a first fastener in said first and second bolt holes, and a second fastener in said first arcuate slot and third bolt hole, whereby when said first and second fasteners are loose, said second fastener may move along the length of said first arcuate slot to adjust the angular relationship of said first and second bracket members and when said first and second fasteners are tightened the angular relationship of said first and second bracket members is fixed, and wherein said forwardly extending plate defines a fourth bolt hole and a spaced away second arcuate slot defined by a radius of curvature about the center of said fourth bolt hole, said first and second arcuate slots being coplanar, and said second bracket member provides fifth and sixth bolt holes, and wherein when a third fastener is disposed in said fourth and fifth bolt holes and a fourth fastener is disposed in said second arcuate slot and sixth bolt hole and when said third and fourth fasteners are loose, said fourth fastener may move along the length of said second arcuate slot to adjust the angular relationship of said first and second bracket members and when said third fastener and said fourth fastener are tightened, the angular relationship is fixed.

8. An RF antenna assembly in accordance with claim 7, and wherein said first bracket member defines a scale along said first arcuate slot, and said first slot arcuate defines a circular arc of at least 30° about said first bolt hole.

9. An RF antenna assembly in accordance with claim 8, and wherein said first arcuate slot defines a circular arc of at least 45° about said first bolt hole.

10. An RF antenna assembly in accordance with claim 7, and wherein said first and second arcuate slots are positioned between said first and fourth bolt holes, and wherein when first and second fasteners are positioned, respectively, in said first and second bolt holes and in said third bolt hole and said first arcuate slot, said second bracket member may move in a counterclockwise direction relative to said first bracket member and when first and second fasteners are positioned, respectively, in said fourth and fifth bolt holes and in said second bolt hole and said second arcuate slot, said second bracket member may move in a clockwise direction relative to said first bracket member.

11. An RF antenna assembly in accordance with claim 7, and wherein each said bracket assembly comprises a third bracket member mounted on said second bracket member, said third bracket member being adapted for securance to an antenna.

12. An RF antenna assembly in accordance with claim 7, and wherein each said second bracket member includes a mounting member which is fixedly secured to said antenna, said second bracket and mounting member being removeably secured, and wherein the back plates of said first bracket members define a common plane, each said mounting member projecting equidistantly outwardly from its associated second bracket member for mounting said antenna in a plane parallel to the plane of said back plates.

13. An RF antenna assembly in accordance with claim 7, and wherein each said second bracket member includes a mounting member which is fixedly secured to said antenna, said second bracket and mounting member being removeably secured, and wherein the back plates of said first bracket members define a common plane, each said mounting member projecting unequally outwardly from its associated second bracket member for mounting said antenna in a plane disposed at an angle to the plane of said back plates.

* * * * *